United States Patent [19]

Hagopian

[11] Patent Number: 5,068,935

[45] Date of Patent: Dec. 3, 1991

[54] FLOTATION THERAPY BED HAVING TWO PART CONSTRUCTION

[75] Inventor: Mark Hagopian, Indian Rocks Beach, Fla.

[73] Assignee: Biologics, Inc., St. Petersburg, Fla.

[21] Appl. No.: 672,730

[22] Filed: Mar. 21, 1991

[51] Int. Cl.[5] ..... A47C 27/08; A61G 7/057

[52] U.S. Cl. ..... 5/451; 5/400; 5/425; 5/429; 4/584

[58] Field of Search ..... 5/451, 452, 450, 449, 5/422, 200.1, 201, 400, 425, 428, 429, 60; 4/538, 546, 584, 589, 590

[56] References Cited

U.S. PATENT DOCUMENTS

| | | | |
|---|---|---|---|
| 3,585,356 | 6/1971 | Hall | 5/451 |
| 3,724,008 | 4/1973 | Golden | 5/451 |
| 3,803,647 | 4/1974 | Reswick | 5/451 |
| 4,127,908 | 12/1978 | Colwell | 5/451 |
| 4,583,252 | 4/1986 | McCourt | 4/546 |
| 4,945,588 | 8/1990 | Cassidy et al. | 5/451 |

*Primary Examiner*—Alexander Grosz

*Attorney, Agent, or Firm*—Ronald E. Smith; Joseph C. Mason, Jr.

[57] ABSTRACT

A flotation therapy bed having a two part construction that includes an upper shell and a lower shell joined along a parting line by a circumferentially extending gasket. The upper shell has a downwardly bowed bottom wall and the lower shell has a flat bottom wall with a large central opening that accommodates the bottom wall of the upper shell when the bed is assembled. Manipulation of a handle releases a pair of springs that drive a hand rail upwardly into its deployed position to prevent a patient from falling out of the bed. A subsequent manipulation of the handle draws the hand rail back into its retracted position. The top edge of the bed is recessed to accommodate the hand rails when lowered.

10 Claims, 6 Drawing Sheets

Fig. 3
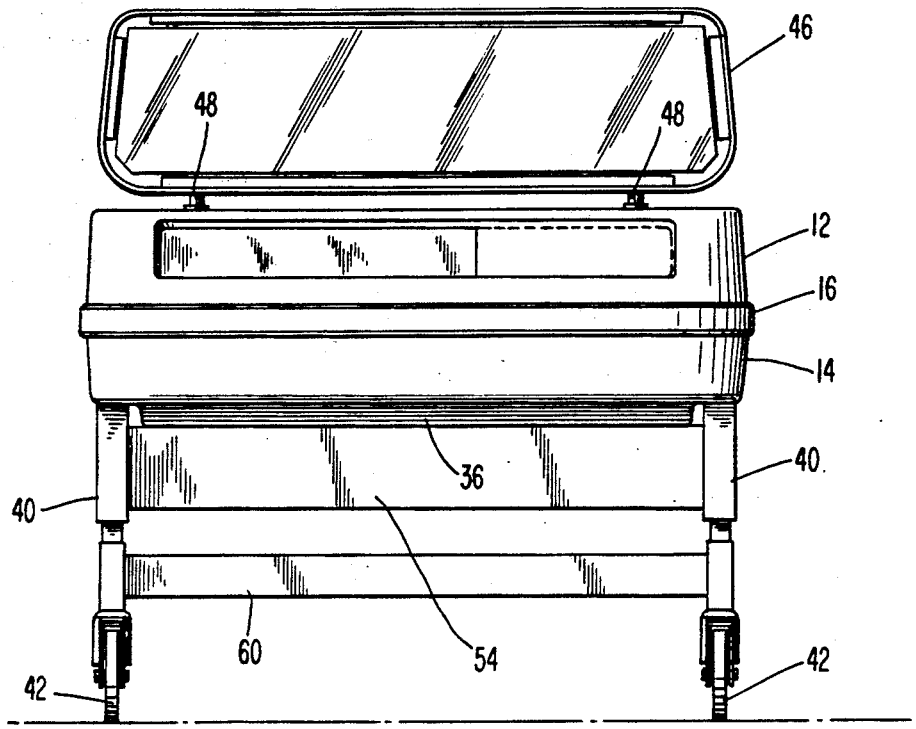
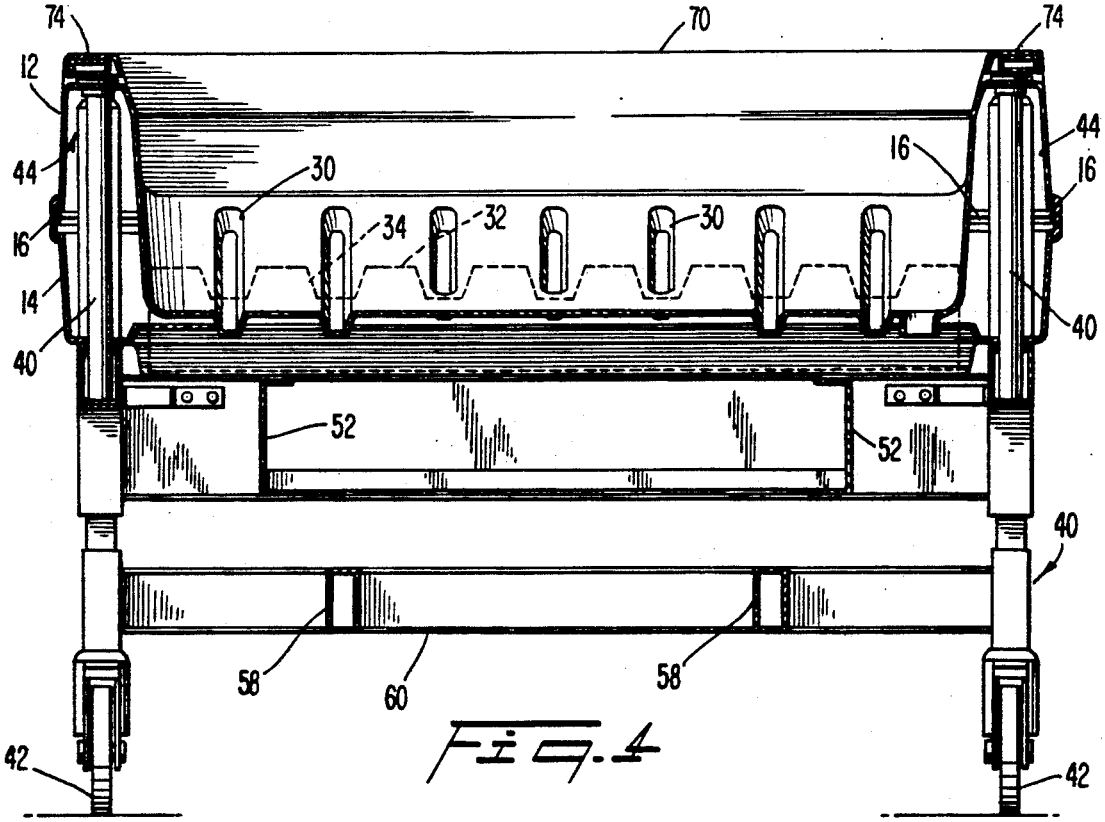
Fig. 4

74
72
92
82
90
94
96
120
104
100
98
76
102
88
116
51
106
118

FLOTATION THERAPY BED HAVING TWO PART CONSTRUCTION

TECHNICAL FIELD

This invention relates, generally, to waterbeds of the type used in therapy. More particularly, it relates to a light in weight waterbed frame having a two part construction.

BACKGROUND ART

Waterbeds have been used for a number of years in hospitals, nursing homes, and the like, because they reduce the chances that a patient will inour decbitus ulcers. However, most waterbeds are so heavy they cannot be used in many facilities without structurally reinforcing the facility. Moreover, they lack such required parts such as side rails that are easily raised and lowered. Moreover, their construction is such that they are difficult to manufacture and thus expensive to the ultimate consumer.

Thus, there is a need for a waterbed of a light in weight and simple construction, but the prior art, when considered as a Whole in accordance with the requirements of law, neither teaches nor suggests to those of ordinary skill in this art how such a bed could be provided.

DISCLOSURE OF INVENTION

The longstanding but heretofore unfulfilled need for a flotation therapy bed that is not subject to the limitations of the earlier devices is now fulfilled by a hospital bed of two part construction. An upper shell and a lower shell are joined to one another along their respective outermost peripheries and a flexible annular band or gasket circumscribes the shells along a horizontally disposed parting line. The floor of the upper shell is bowed downwardly and the floor of the lower shell has a large opening formed therein to accommodate the bowed upper shell.

The uppermost longitudinally extending peripheral edges of the upper shell are recessed or countersunk to accommodate retracted side rails that are biased upwardly so that turning of a handle in a first direction effects immediate raising of the rails into their deployed configuration. Novel mechanical means are provided to lock the rails in their raised positions when the handle is released. A manipulation of the handle in an opposite direction effects immediate lowering of the rail and the novel mechanism locks the rails in said lowered position.

The bowed upper shell bottom wall is supported at longitudinally spaced intervals by transversely disposed support members that accommodate drainage grooves formed in said upper shell bottom wall. The support members are positioned within transverse recesses formed in the bottom wall of the lower shell.

The primary object of this invention is to advance the art of therapeutico waterbeds by providing a structure that has two primary parts that are joined along a parting line to thereby facilitate its manufacture.

Another important object is to provide a side rail construction of novel mechanical design.

These and other important objects, advantages and features of the invention will become apparent as this description continues.

The invention accordingly comprises the features of construction, combination of elements and arrangements of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the following drawings, in which:

FIG. 3 is an end view thereof;

FIG. 4 is a transverse sectional view taken along line 4—4 in FIG. 7;

Similar reference numerals refer to similar parts throughout the several views of the drawings.

BEST MODES FOR CARRYING OUT THE INVENTION

Figure 1:
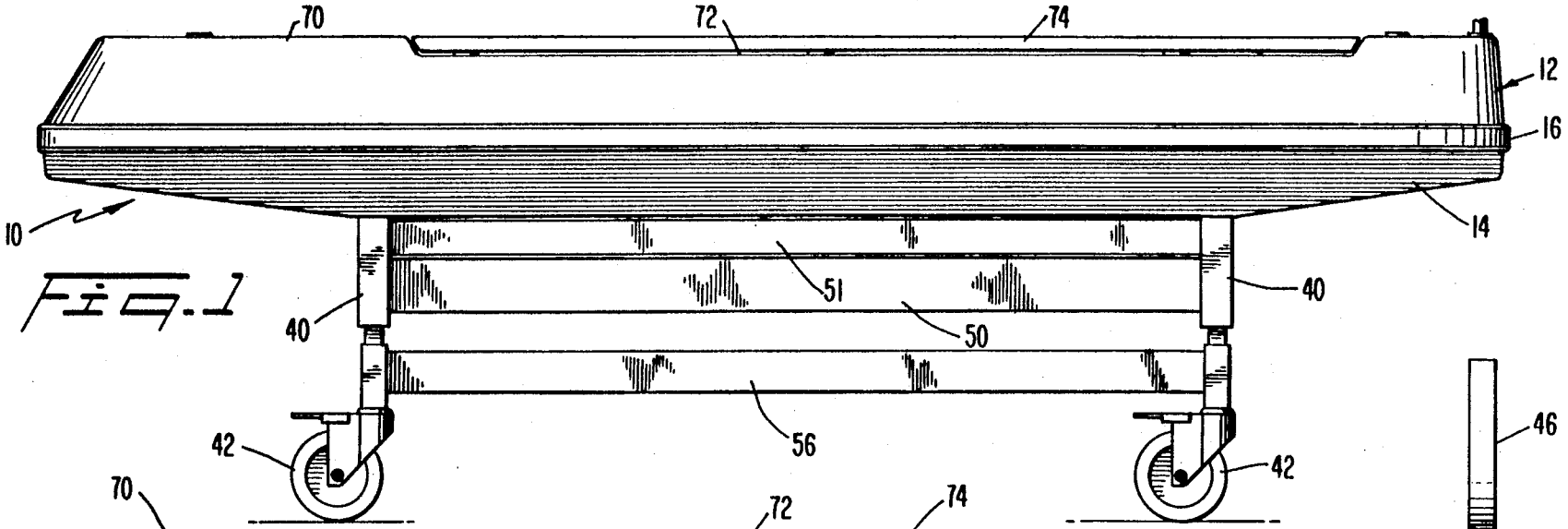
FIG. 1 is a side elevational view of an exemplary embodiment of the present invention.

Referring now to FIG. 1, it will there be seen that an exemplary embodiment of the invention is denoted as a whole by reference numeral 10.

Flotation therapy bed 10 includes upper shell 12 of monolithic construction, lower shell also of one piece construction, and a continuous, flexible annular band or gasket 16 that joins said parts to one another. More particularly, as perhaps best understood in connection with FIG. 5, gasket 16 has a "T"-shaped transverse cross section and engages the lowermost peripheral edge 18 of top part 12 and the uppermost peripheral edge 20 of bottom part 14 when the bed 10 is assembled. Thus, the edges 18 and 20 are spaced from one another by the protruding part 21 of gasket 20, as may be determined upon close inspection of FIG. 2.

Figure 2:
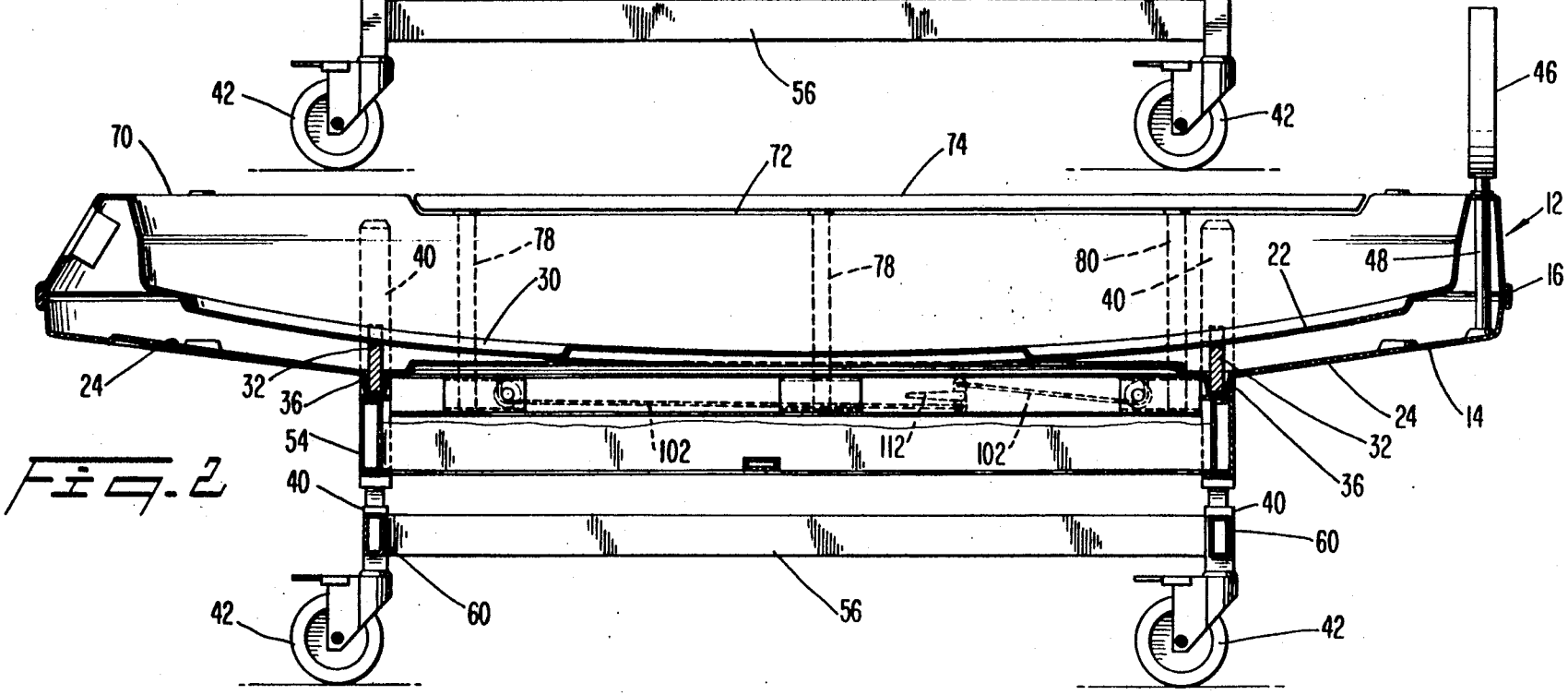
FIG. 2 is a longitudinal sectional view thereof, taken along line 2—2 in FIG. 7.
Figure 5:
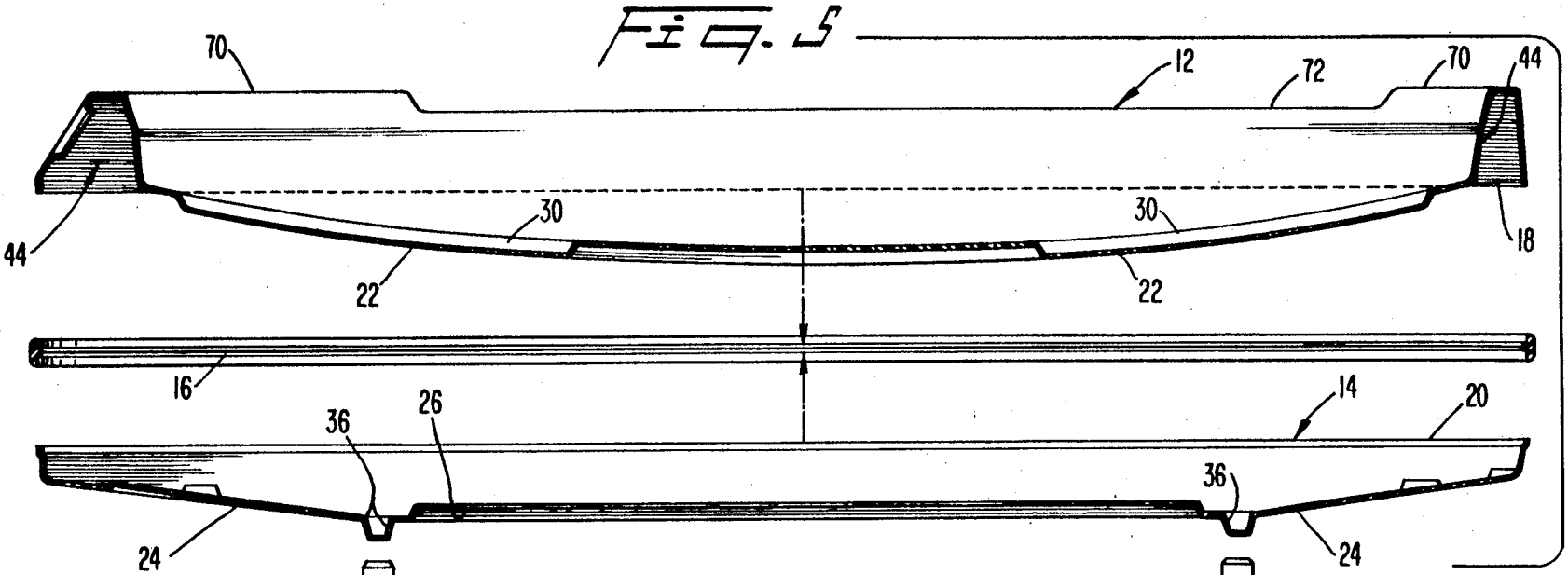
FIG. 5 is an exploded longitudinal sectional view of the upper and lower shells.
Figure 6:
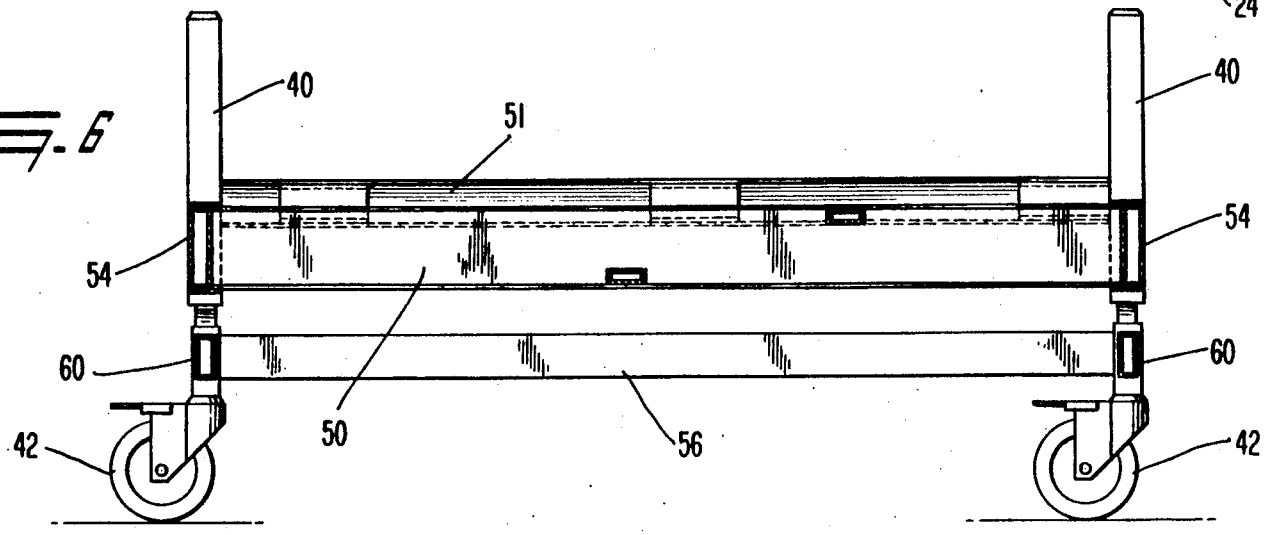
FIG. 6 is a side elevational view of the structure that supports the upper and lower shells.

As best understood in connection with FIG. 5, upper shell 12 has a downwardly bowed, imperforate bottom wall 22 whereas the bottom wall 24 of lower shell 14 is generally flat. Just as importantly, top shell 12 has a greater depth than does bottom shell 14. This unique design of said top and bottom parts includes a large opening 26 formed in bottom wall 24 of lower part 14 to accommodate the bowed bottom wall 22 of top part 12. The size and shape of opening 26 is perhaps best understood in connection with FIG. 7, and the accommodation of the bowed bottom wall 22 within said opening 26 is best depicted in FIG. 2.

Figure 7:
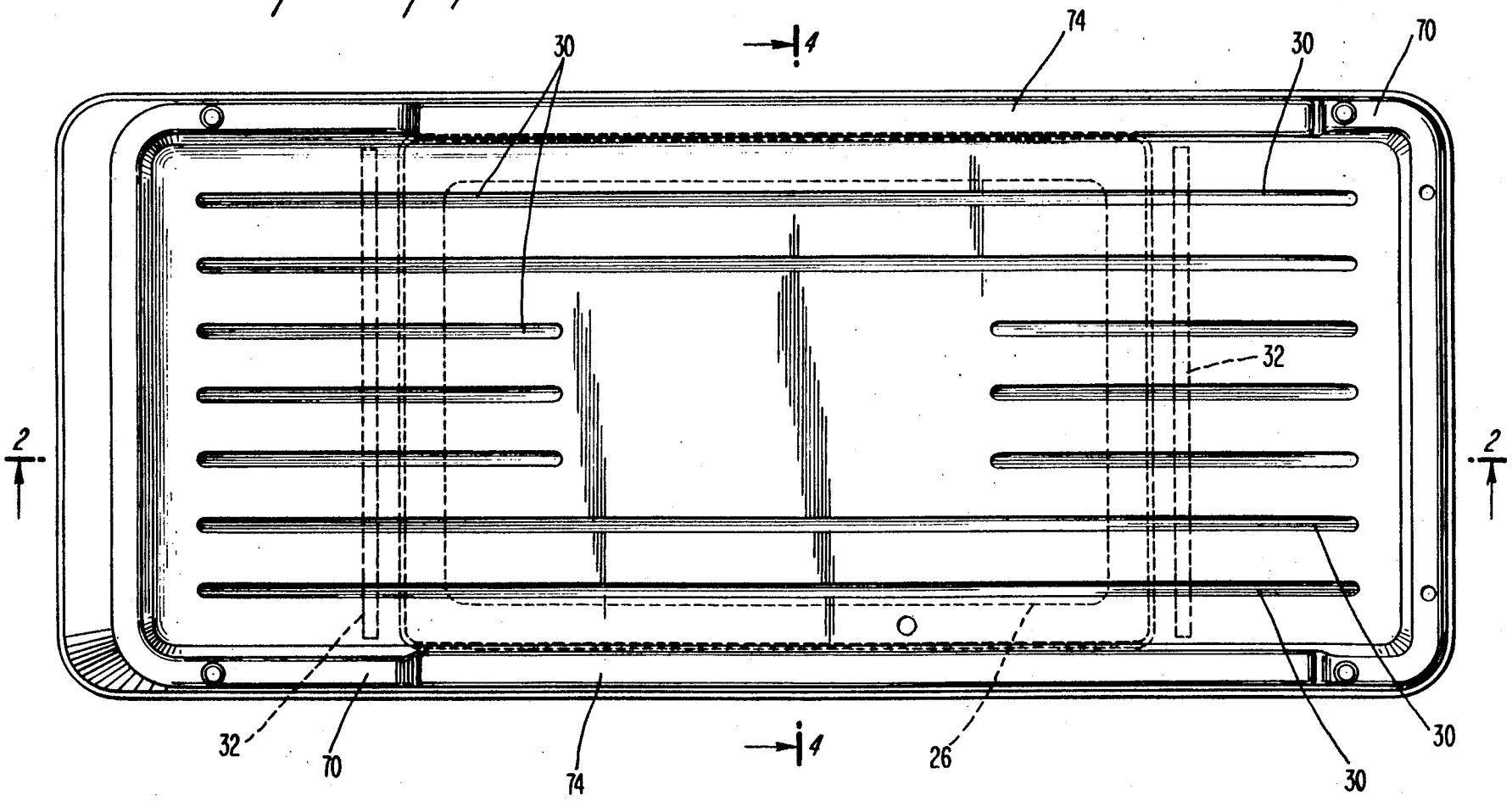
FIG. 7 is a top plan view of the novel bed.

A plurality of laterally spaced, longitudinally aligned drainage grooves, collectively denoted 30, are formed in bottom wall 22 of top part 12, as best shown in FIG. 7. The laterally outermost grooves extend about the entire longitudinal extent of bottom wall 22, but the innermost grooves are discontinuous in the middle area of the bottom wall 22 as shown in said FIG. The transversely disposed, longitudinally spaced apart members 32 that appear in phantom lines in FIG. 7 are support or spacer members that are supported by bottom wall 24 of bottom part 14 and which support bottom wall 22 of upper part 12 as best shown in FIG. 2. Note in FIG. 4 that support members 32 are notched at equidistantly spaced transverse intervals as at 34 to accommodate drainage grooves 30. As depicted in FIG. 4, said grooves 30 project outwardly from the plane of the paper in depending relation from bottom wall 22 of upper part 12. The lowermost edges of support members 32, as shown in FIG. 2, are received within transverse grooves 36 formed in bottom wall 24.

As shown in FIG. 4, bed 10 is supported by telescoping leg members 40 that are in turn supported by caster wheels 42. Suitable hydraulic means are employed to extend and retract the telescoping legs. Each leg 40 extends through an associated aperture formed in bottom wall 24 and into a peripheral cavity 44 (FIG. 5) that is formed in top part 12 by the outwardly and downwardly flared side walls thereof. A headboard 46 (FIGS. 2 and 3) is supported by legs 48 that also extend into said cavity 44, at the head of the bed.

The bed is braced in part by a pair of longitudinally disposed upper frame members 50 (FIG. 1) that interconnect the forward and rearward leg members 40 and a pair of brace members 52 (FIG. 4) that are disposed inwardly of frames 50 in parallel relation thereto. Further bracing is provided by forward and rearward upper transverse brace members 54 (FIG. 3) that are positioned in interconnecting relation to the forward and rearward legs 40, respectively. The same arrangement of brace members is provided just below the just-described structure. Specifically, a pair of transversely spaced, longitudinally extending lower brace members 56 (FIG. 1) interconnect the forward and rearward legs 40 and a pair of longitudinally spaced brace members 58 (FIG. 4) are disposed inwardly thereof in parallel relation thereto and are secured at their opposite ends to lower transverse braces 60. All of these brace members are hollow and of light in weight construction.

The balance of this disclosure is directed to the hand rails and the mechanism for raising and lowering them. Note in FIG. 1 that the upper peripheral edge 70 of bed 10 is recessed as at ? 2 and that hand rails 74 are received within said recess 72 so that the upper edge of said hand rails is flush with upper edge 70 of the bed, i.e., edge 70 is countersunk to accommodate said hand rails when the hand rails are in their lowermost or retracted position as depicted in FIG. 1.

Figure 8:
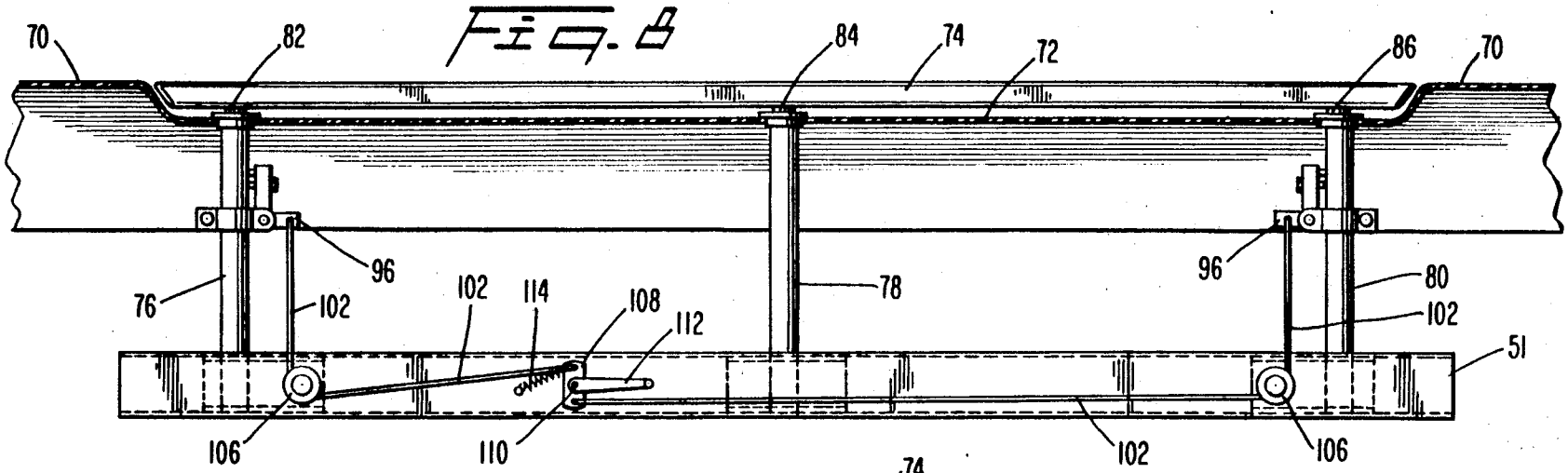
FIG. 8 is a detailed side elevational view of the side rail raising and lowering mechanism when the side rails are in their lowered configuration.
Figure 9:
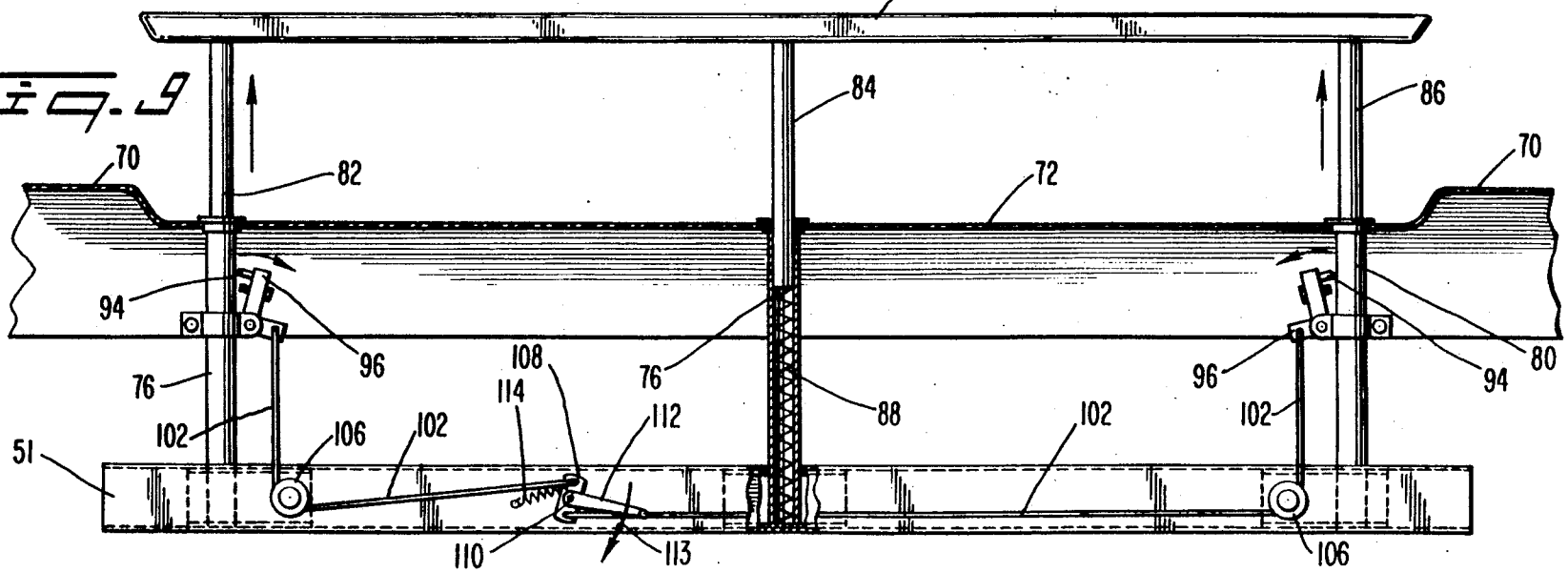
FIG. 9 is a view similar to that of FIG. 8, but showing the side rails, in their raised configuration.

Note in FIG. 2 that hand rails 74 are apparently supported at their opposite ends and mid-length thereof by tubular members 76, 78, and 80. However, as can be ascertained upon closer inspection of FIG. 2, and as is clearly shown in FIGS. 8 and 9, said tubular members are housings that telescopically receive support members 82, 84, and 86, respectively. FIG. 8, like FIG. 1, depicts the support members and hence the hand rails in their fully retracted positions, whereas FIG. 9 shows the support members and hand rails in their fully extended position. A bias means 88, only one of which is shown in FIG. 8, is positioned in each tubular member 76, 78, and 80 and is under compression when the hand rails are down. Thus, said bias means serve to deploy support members 82, 84, and 86 into their extended positions when released. The means for releasing the bias means 88 is best understood in connection with FIGS. 8–12.

Figures 10, 11, 12:
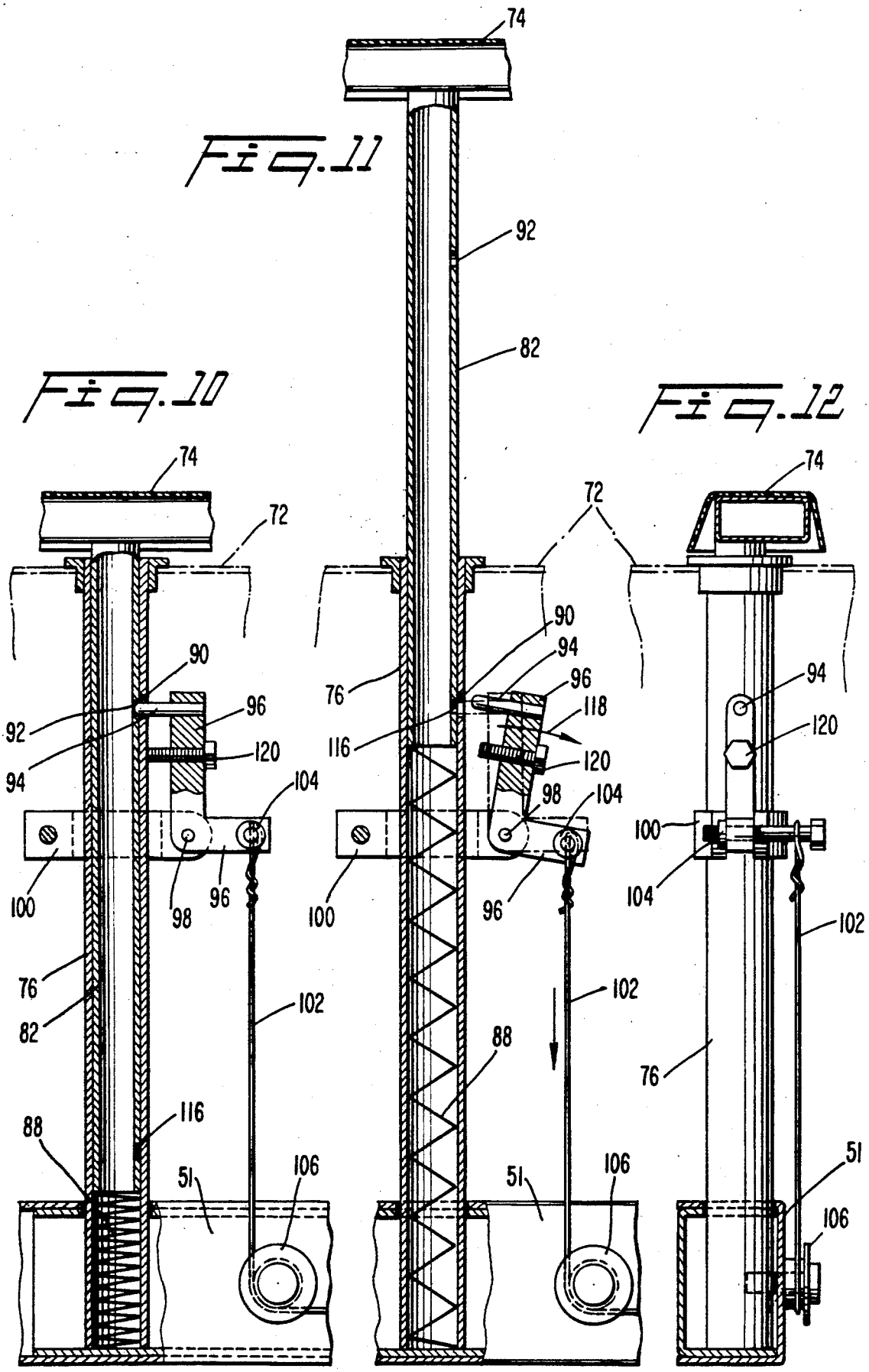
FIG. 10 is a sectional view showing the raising and lowering mechanism in still greater detail, with the side rails in their lowered configuration.
FIG. 11 is a view of the same parts shown in FIG. 10, but showing the side rails in their raised configuration.
FIG. 12 is a frontal view of the parts shown in FIG. 10.

Tubular housing 76 is apertured as at 90 (FIG. 10) and support member 82 received therewithin is similarly apertured as at 92; said apertures 90 and 92 are in alignment with one another only when support member 82 is fully received within housing 76, i.e., when bias means 88 is fully compressed as shown. When so aligned, said apertures collectively receive a pin member 94 that is mounted to bell crank 96 which in turn is pivotally mounted as at 98 to a fixed position bracket 100. A flexible, elongate cable 102 is secured to the opposite end 104 of bell crank 96 and said cable wraps around pulley 106. As best shown in FIGS. 8 and 9, cable 102 then extends to a pivot plate 108 that is pivotally mounted as at 110 to a frame member 51 that is positioned just above frame member 50. The opposite ends of plate 110 are apertured to facilitate connection of cable 102 thereto. Note from the right hand side of FIGS. 8 and 9 that the same arrangement of parts is associated with housing 80 and support member 86, said parts being cooperatively apertured to receive a second pin 94 in the same way. Handle 112 is fixedly secured to pivot plate 110 so that when said handle 112 is rotated as indicated by the directional arrow 113 in FIG. 9, both pins 94 are retracted from their respective FIG. 10 positions. As shown in FIG. 11, the potential energy stored by bias means 88 is converted into kinetic energy upon the retraction of said pins 94, thereby driving the support members and hence hand rails 74 upwardly to prevent the patient from rolling out of the bed 10. A second bias means 114 (bottom of FIG. 9), biases handle 112 to return to its position of equilibrium so that when the operator of handle 112 releases said handle upon observing the spring-loaded deployment of the hand rails, bell crank 96 will return to its position of equilibrium, i.e., to its unrotated position, i.e., said pin will return to its seat in aperture 90 formed in its associated housing 76 or 80. As shown in FIG. 11, a second aperture 116 is formed in the trailing end of support member 82 (and 86), and said second aperture 116 aligns with aperture 90 when bias means 88 is fully unloaded as depicted in FIG. 11. Thus, upon the release of handle 112, bias means 114 rotates pivot plate 108 in a direction opposite to that of arrow 113 in FIG. 9, and pin 94 travels in a direction opposite to that indicated by arrow 118 in FIG. 11 and seats within aligned apertures 90 and 116 to lock the hand rails in their raised position. Subsequent rotation of handle 112 withdraws pins 94 from said alignment, and bias means 88 pulls support members 82 and 86, to which said bias means is attached, back into their associated housings 76 and 80, respectively, as said bias means 88 regains its equilibrium. The hand rails thus deploy and retract quickly upon rotation of handle 112, so that the task or raising and lowering said hand rails as required consumes a nominal amount of time at most. Screw 120 is supplied to enable adjustment of the cable system.

This invention is clearly new and useful. Moreover, it Was not obvious to those of ordinary skill in this art at the time it was made, in view of the prior art considered as a whole in accordance with the requirements of law.

It will thus be seen that the objects set forth above, and those made apparent from the foregoing description, are efficiently attained and since certain changes can be made in the above description without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

WHAT IS CLAIMED IS

1. In a flotation therapy bed in which a patient is supported on a fluid containing bladder to thereby avoid decubitus ulcers, the improvement comprising:

an upper shell having a downwardly bowed bottom wall;

a lower shell having a substantially flat bottom wall;

an opening formed in .said bottom wall of said lower shell, centrally thereof;

said upper shell having a predetermined depth greater than a predetermined depth of said lower shell; and said bowed bottom wall of said upper shell being at least partially received within said opening of said lower shell when said bed is assembled.

2. In the bed of claim , further comprising an elongate flexible gasket that circumscribes the bed at a parting line where said upper shell meets said lower shell, said gasket hiding said parting line and separating said upper and lower shells from one another.

3. In the bed of claim 2, further comprising a pair of longitudinally spaced apart, transversely disposed support members that overlie and are supported by said bottom wall of said bottom shell and that underlie and support said bottom wall of said upper shell.

4. In the bed of claim 3, further comprising a plurality of longitudinally extending, laterally spaced apart drainage grooves formed in said upper shell bottom wall that depend from said bottom wall, and wherein said support members are notched to receive said depending grooves.

5. In the bed of claim 4, further comprising a pair of longitudinally spaced, transversely disposed grooves formed in said lower shell bottom wall, said grooves receiving said support members.

6. In the bed of claim 5, further comprising a pair of hand rails positioned on opposite sides of said bed, said hand rails having a raised position and a lowered position, and said hand rails including means for raising and lowering said hand rails in the absence of direct manipulation thereof.

7. In the bed of claim 6, wherein said means for raising and lowering includes plural upstanding support members that depend from opposite ends of said hand rails, plural housing members associated with and which telescopically receive said upstanding support members, a bias means positioned within each of said housing members, each of said bias means having an upper end secured to a lower end of its associated upstanding support member, and means for locking said hand rails in their respective lowered positions, said bias means being compressed when said hand rails are in said lowered positions.

8. In the bed of claim 7, further comprising means for locking said hand rails in their respective raised positions.

9. In the bed of claim 8, wherein said means for locking said hand rails includes a pivotally mounted bell crank, a pin carried by a first end of said bell crank, a first end of a cable secured to a second end of said bell crank, a second end of said cable secured to a pivotally mounted pivot plate, a rigid handle secured to said pivot plate so that manipulation of the handle effects longitudinal displacement of said cable, a first aperture formed in said housing member, a second aperture formed in a first end of said support member that is telescopically received within said housing member, and a third aperture formed in a second end of said support member, said pin extending through said first and second apertures when the hand rails are down and said pin extending through said first and third apertures when said hand rails are raised, said pin being withdrawn from said first aperture when said handle is rotated.

10. In the bed of claim 9, wherein an uppermost peripheral edge Of said bed is recessed to accommodate said hand rails when said hand rails are down.

* * * * *